US009573160B2

(12) United States Patent
Roe

(10) Patent No.: US 9,573,160 B2
(45) Date of Patent: Feb. 21, 2017

(54) CAULKING GUN AND SEALANT CARTRIDGE

(71) Applicant: Australian Brushware Corporation Pty Ltd, Campbellfield (AU)

(72) Inventor: Matthew Lee Roe, Campbellfield (AU)

(73) Assignee: AUSTRALIAN BRUSHWARE CORPORATION PTY LTD, Victoria (AU)

( * ) Notice: Subject to any disclaimer, the term of this patent is extended or adjusted under 35 U.S.C. 154(b) by 0 days.

(21) Appl. No.: 14/659,711

(22) Filed: Mar. 17, 2015

(65) Prior Publication Data

US 2015/0258569 A1 Sep. 17, 2015

(30) Foreign Application Priority Data

Mar. 17, 2014 (AU) ..... 2014900916

(51) Int. Cl.
*B65D 88/54* (2006.01)
*B05C 17/01* (2006.01)
*B65D 83/00* (2006.01)

(52) U.S. Cl.
CPC ..... *B05C 17/0123* (2013.01); *B05C 17/01* (2013.01); *B65D 83/0072* (2013.01)

(58) Field of Classification Search
CPC ..... G01F 11/026; F16N 3/12; B05C 17/005; B05C 17/01; B05C 17/0123; B65D 83/0072
USPC ..... 222/325–327; 285/331, 386, 387
See application file for complete search history.

(56) References Cited

U.S. PATENT DOCUMENTS 174,035 A * 2/1876 Vick ..... F16L 47/04 285/331
329,545 A * 11/1885 Foley ..... B23B 31/1074 175/414
335,101 A * 2/1886 Adams ..... F16L 27/04 285/263
1,710,267 A * 4/1929 Mueller ..... F16L 19/025 285/184
1,751,128 A * 3/1930 Cocks ..... A47K 5/1211 184/39
2,833,450 A * 5/1958 Sherbondy ..... B05C 17/00516 222/327
3,188,057 A * 6/1965 Trumbull ..... B01F 11/0054 222/229
3,813,012 A * 5/1974 Laird ..... B05C 17/015 222/326
3,819,091 A * 6/1974 Hollender ..... A61M 5/315 222/327

(Continued)

*Primary Examiner* — Patrick M Buechner
(74) *Attorney, Agent, or Firm* — Patterson Thuente Pedersen, P.A.

(57) ABSTRACT

A cartridge suitable for containing a sealant material and a matching caulking gun. The cartridge comprises an elongate hollow body defined by a peripheral wall. A coupling flange extends outwardly from at least a portion of the peripheral wall and has an abutment surface configured to enable engagement with a corresponding abutment surface of a caulking gun, to thereby connect the cartridge to the caulking gun. The abutment surface of the coupling flange faces upwardly towards the top end of the cartridge body and is disposed at an obtuse angle with respect to the peripheral wall so as to enable a downward force to be applied to the flange by a corresponding downwardly facing abutment surface of a caulking gun.

22 Claims, 13 Drawing Sheets

(56) References Cited

U.S. PATENT DOCUMENTS 3,894,663 A * 7/1975 Carhart ..... B05C 17/0123
222/309
4,090,639 A * 5/1978 Campbell ..... G01F 11/026
222/309
4,338,925 A * 7/1982 Miller ..... A61B 17/8811
604/61

* cited by examiner

CAULKING GUN AND SEALANT CARTRIDGE

RELATED APPLICATION

The present application claims priority to Australian Application No. 2014900916 filed Mar. 17, 2014, which is incorporated herein in its entirety by reference.

FIELD OF THE INVENTION

The present invention relates to caulking guns and sealant cartridges containing sealant material. The invention also relates to a coupling mechanism for connecting a caulking gun to a sealant cartridge.

BACKGROUND TO THE INVENTION

Caulking guns have traditionally included a long barrel-shaped body or open frame for holding a sealant cartridge. The barrel-shaped body or frame is connected to a gun body containing a longitudinally extending piston rod with a push-plate mounted on its end and a trigger for inducing extension of the piston rod in the direction of the barrel body for dispensing sealant material from a sealant cartridge.

Sealant cartridges on the other hand have conventionally been formed with a long cylindrical body for containing sealant material, with a piston inserted in an opening at a bottom end of the cylindrical body for driving sealant material through the body, and an outlet at the top end of the body for dispensing material once opened.

By squeezing a trigger of a caulking gun loaded with a sealant cartridge, the user activates the piston rod, which then extends into the barrel-shaped body of the caulking gun. The push-plate mounted on the end of the piston rod then serves to drive the piston at the bottom end of the cartridge and push sealant material out of the cartridge body through the outlet.

Throughout this specification, references to orientation of a sealant cartridge and/or caulking gun are for convenience only, and assume that the cartridge is standing vertically on a horizontal surface with the outlet at the top. Thus, the terms 'top' and 'bottom' are not absolute terms but are relative, assuming the cartridge body is standing vertically as indicated. Similarly, references to 'up' and 'down' and similar terms are to be interpreted in the same way and are not intended to indicate any particular required orientation of the cartridge body or caulking gun.

Also throughout this specification, the phrase 'sealant material' is used to refer not only to typical flexible sealers of the type used to seal gaps left between abutting components in building construction, but also to encompass similar substances such as construction adhesives, wood preservative gels, and any other viscous material which is capable of being stored within a cartridge and then dispensed by a piston being forced along the length of the cartridge body. Thus, the phrase 'sealant material' is used more generally to refer to a range of materials having this property.

In one respect, the overall length of the barrel-shaped body of a conventional caulking gun, and the standard sized sealant cartridge (215 mm in length, or 320 mm in length including a typical dispensing nozzle), together with the combined weight, make the conventional caulking gun a rather cumbersome tool. This makes it difficult for the user to access and maneuver the tool in small or tight areas for dispensing sealant material. Such areas may include: behind walls or inside roofs, inside cabinets and underneath sinks.

In a similar vein, storage may prove to be problematic for the user who may find they need to find an equally lengthy storage area for putting away the tool.

Furthermore, when using a traditionally caulking gun and standard cartridge to perform smaller tasks, the user often does not require all of the sealant material contained in the standard sized sealant cartridge. This can lead to surplus, disposal of a partially used sealant cartridge and wastage, which also is not good for the environment.

The conventional caulking gun also relies on the piston rod within the gun body to be firmly connected to the piston in the cartridge, failing which it is possible for the cartridge to fall out of the gun. This can become dangerous for use at or above head height around other people and in certain settings such as construction sites.

The present invention aims to address one or more of these problems and drawbacks associated with conventional sealant cartridges and caulking guns.

SUMMARY OF THE INVENTION

According to one aspect of the present invention there is provided a cartridge suitable for containing a sealant material, the cartridge comprising an elongate hollow body defined by a peripheral wall extending between a top end and a bottom end of the body, the top end having an outlet for dispensing sealant material from the cartridge and the bottom end being closed by a slidable piston, wherein the piston is adapted to retain the sealant material within the body and is slidable within the body to thereby cause the sealant material to be discharged through the outlet, the cartridge further comprising a coupling flange extending outwardly from at least a portion of the peripheral wall and having an abutment surface configured to enable engagement with a corresponding abutment surface of a caulking gun to thereby connect the cartridge to the caulking gun, wherein the abutment surface of the coupling flange faces upwardly towards the top end of the cartridge body and is disposed at an obtuse angle (between 90° and 180°) with respect to the peripheral wall of the cartridge body so as to enable a downward force to be applied to the flange by a corresponding downwardly facing abutment surface of a suitable designed caulking gun.

As will be appreciated, it is the relationship between the angled abutment surface of the cartridge and the correspondingly angled abutment surface of the caulking gun which is a key characteristic and major advantage of the invention. The obtuse angle of the corresponding abutment surfaces facilitates centering of the coupling flange on the caulking gun, and hence makes for a more rigid connection between the cartridge and the gun.

In a preferred embodiment, the obtuse angle is between about 125° and 145° and more preferably about 135°.

In a preferred embodiment, the coupling flange is continuous about the peripheral wall of the cartridge body such that the flange surrounds the body. In an embodiment where the cartridge body is cylindrical (which it need not necessarily be) and where the flange is of uniform cross-section, then the flange would have an outer diameter greater than the outer diameter of the cartridge body. It would also have a height (or thickness) which is uniform about the body.

In an alternative embodiment, however, the coupling flange need not be continuous and may instead be formed as discontinuous sections about the peripheral wall. In effect, these sections of the flange form a plurality of projections extending outwardly from the peripheral wall.

Preferably, each section of the flange may be configured to align with corresponding apertures in an opening of a suitably configured caulking gun body. Such an arrangement may operate in a manner somewhat similar to a conventional bayonet fitting. The flange sections may, in this embodiment, engage with grooves provided in the opening of the caulking gun body.

Alternatively, the flange sections forming projections from the peripheral wall of the cartridge body may be grasped by appropriately shaped clips or clamping members extending from the caulking gun. These clips or clamping members may then apply a downward force on the projections to secure the cartridge to the gun.

In one embodiment, the coupling flange (continuous or discontinuous) is located adjacent the bottom end of the peripheral wall. A continuous flange could then simply be a thickened wall section at the bottom end of the wall. Alternatively, the coupling flange may be located further up the wall, away from the bottom end. Which location is most preferred would depend on the exact form of the caulking gun.

In a particularly preferred embodiment, the coupling flange includes a downward facing channel, or groove, to assist alignment of the cartridge with a corresponding locating lip of a caulking gun. Such a channel, especially when provided in a bottom surface of the coupling flange, provides additional centering features of the coupling flange relative to the caulking gun, and hence makes for an even more rigid connection between the cartridge and the gun.

Preferably, the outlet of the cartridge includes a hollow protrusion through which the sealing material can be dispensed. The hollow protrusion may itself be shaped so as to form a dispensing nozzle or alternatively the protrusion may include means to enable a nozzle to be connected thereto. In one example, the protrusion may include an external thread to enable a corresponding internal thread of a dispensing nozzle to be connected. Alternatively, the protrusion may include an internal thread to enable a dispensing nozzle having a corresponding external thread to be connected.

In one embodiment, the protrusion extends from a top wall of the cartridge body and is centered in the top wall. Alternatively, it may be off-centered in the top wall. As a further alternatively, the protrusion may extend from the peripheral wall rather than the top wall, or may extend from a location adjacent an intersection between the peripheral wall and the top wall.

Preferably, the length of the cartridge body is less than 215 mm and, more preferably, is within the range of 100-200 mm and, in one example, is about 150 mm.

Another aspect of the present invention provides a caulking gun which is specifically designed for use with the sealant cartridge described above.

More specifically, this aspect of the invention provides a caulking gun for dispensing sealant material from a cartridge, the cartridge comprising an elongate hollow body defined by a peripheral wall extending between a top end and a bottom end of the body, the top end having an outlet for dispensing sealant material from the cartridge and the bottom end being closed by a slidable piston, wherein the piston is adapted to retain the sealant material within the body and is slidable within the body to thereby cause the sealant material to be discharged through the outlet, the cartridge further comprising a coupling flange extending outwardly from at least a portion of the peripheral wall and having an upwardly facing abutment surface disposed at an obtuse angle with respect to the peripheral wall. The caulking gun comprise a coupling mechanism to enable the cartridge to be releasably connected to the caulking gun, wherein the coupling mechanism is configured to surround at least a portion of the cartridge body and includes an abutment surface which is shaped to engage the abutment surface of the coupling flange on the cartridge, to thereby connect the caulking gun to the cartridge. More specifically, the abutment surface of the caulking gun's coupling mechanism faces downwardly towards the bottom end of the cartridge body and is disposed at an obtuse angle with respect to the peripheral wall of the cartridge. This enables a downward force to be applied to the coupling flange and also provides a degree of self-centering which facilitates a more rigid connection between the cartridge and the gun.

This form of caulking gun does not need a barrel-shaped body or open frame to hold the cartridge as in conventional caulking guns. The gun can therefore be made much smaller than conventional guns.

In a preferred embodiment, the coupling mechanism fully surrounds the cartridge body to enable engagement with a continuous flange surrounding the cartridge body. Alternatively, however, the coupling mechanism may be in the form of a sectional enclosure which corresponds with a discontinuous flange of the cartridge body. A bayonet style fitting could thereby be formed with the cartridge flange.

In a preferred embodiment, the coupling mechanism includes a clamping arrangement to pull the respective abutment surfaces of the cartridge and caulking gun together to thereby rigidly connect the cartridge to the gun.

In one form, the coupling mechanism includes a fastening band which is shaped to surround the flange and body of the cartridge. In this embodiment, the band has an inwardly projecting lip which is configured to extend over the flange towards the peripheral wall of the body. The angled abutment surface of the caulking gun is accordingly disposed beneath the lip of the band.

In a preferred embodiment, the fastening band is circular in cross-section so as to form an annular ring. This form of fastening band would be suitable for a cartridge having a cylindrical body. The annular ring then encircles the cylindrical wall of the body as well as the outer periphery of the coupling flange. The inwardly projecting lip of the annular ring then forms an aperture having a diameter which is smaller than an internal diameter of the remainder of the annular ring. Preferably, the internal diameter of the annular ring is sized to accommodate the external diameter of the coupling flange of the cartridge, and the diameter of the aperture formed by the lip is sized to accommodate the external diameter of the body of the cartridge. In this way, the body of the cartridge may be inserted through the annular fastening ring until the upper surface (the abutment surface) of the coupling flange meets with the lower surface (the abutment surface) of the inwardly projecting lip of the fastening ring.

As with the cartridge described previously, the abutment surface of the caulking gun is disposed at an obtuse angle with respect to the internal wall of the annular ring, so as to match the obtuse angle of the abutment surface of the coupling flange of the cartridge. Preferably, this obtuse angle is between 125° and 145° and more preferably about 135°.

In one embodiment, the annular ring includes an internal thread which is configured to engage with an external thread associated with a body portion of the caulking gun. In this way, rotation of the annular ring causes the respective abutment surfaces to be drawn together.

In a preferred embodiment, the caulking gun includes an upwardly projecting locating lip which is shaped and positioned to assist alignment of the caulking gun with a corresponding downwardly facing channel or groove of the cartridge. This configuration serves to provide an additional centering function, such that the cartridge is always placed correctly on the gun, and thereby facilitates a quick and sturdy connection.

In one embodiment, the caulking gun body includes a piston rod, in a similar fashion to conventional caulking guns. The piston rod preferably comprises a push-plate mounted at the forward end of the rod and is slidable relative to the gun body. Preferably, the piston rod is extendable through an opening of the gun body and through the inside of the fastening ring once the ring and the opening are in a fastened position. Furthermore, the piston rod is connected to a drive system for driving movement of the rod through the ring and into the bottom end of the cartridge.

The caulking gun preferably also includes a trigger mounted to the gun body. The trigger is squeezable in respect of a drive system for driving the rod in the direction of the cartridge and provides the necessary pressure for dispensing the sealant material from the cartridge.

The caulking gun preferably also includes a handle secured to the gun body. The handle may include a square hole at the upper end of the handle for inserting a seal portion of the cartridge outlet and then twisting it to snap off the seal of the outlet for opening the cartridge.

It will be appreciated from the foregoing description that the key features of the preferred embodiment reside in two main parts: the flange of the cartridge and the inwardly projecting lip of the fastening ring, each having a correspondingly angled abutment surface. In addition, the downwardly projecting channel in the bottom surface of the coupling flange of the cartridge together with the upwardly projecting locating lip of the gun serve to provide a very sturdy connection between the cartridge and the gun. These parts all work together to hold the cartridge in place when the ring and the opening of the gun body are in a fastened position. With reference to FIG. 17, the fastened position entails fully threading the fastening ring to the caulking gun body, such that a rearward end of the fastening ring makes abutting contact with a portion of the caulking gun body. When together, the point of connection between the ring and the opening is secure. However, the point of connection is such that these two parts can quickly and easily be separated from each other, and just as quickly and easily realigned.

Unlike a conventional caulking gun, the piston rod does not need to be fully extended into the bottom end of the cartridge in order to lock the cartridge in place. In the preferred embodiment of the invention, it is the inwardly projecting lip of the fastening ring working in conjunction with the outwardly extending flange of the sealant cartridge which locks the sealant cartridge in place. These features allow for quick and easy assembly without requiring the caulking gun to have an extended barrel-shaped body, or equivalent open frame, as seen in conventional caulking guns, and without fear that a loaded cartridge will become loose and fall out of the gun. This makes the caulking gun and cartridge of the preferred embodiment safer to use.

Together, the absence of a barrel-shaped body holding the sealant cartridge, and the compact size of the cartridge, help the user to dispense material in tighter and smaller spaces. This also allows for the caulking gun, with or without the cartridge attached, to be stored away neatly in a compact space, such as a small toolbox or drawer. Furthermore, the cartridge is rotatable in any direction as required, which also helps improve access and maneuverability. Finally, the smaller volume of sealant material contained by the compact sealant cartridge helps reduce the likelihood of surplus and wastage, which will also help the environment.

The terms 'comprises', 'comprising' and grammatical variations thereof, when used in this specification are to be taken to specify the presence of stated features, integers, steps or components or groups thereof, but do not preclude the presence or addition of one or more other features, integers, steps, components or groups thereof.

BRIEF DESCRIPTION OF THE DRAWINGS

To gain a better understanding of the present invention, certain preferred embodiments are described below, by way of example only, with reference to the accompanying drawings, in which.

DETAILED DESCRIPTION OF PREFERRED EMBODIMENTS

Figure 1:
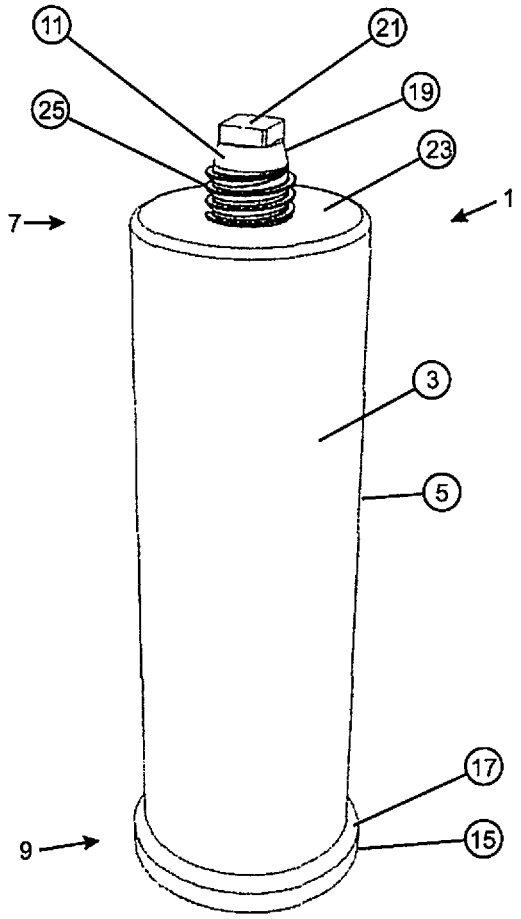
FIG. 1 is a perspective view of a compact sealant cartridge in accordance with a particular preferred embodiment of the present invention.
Figure 2:
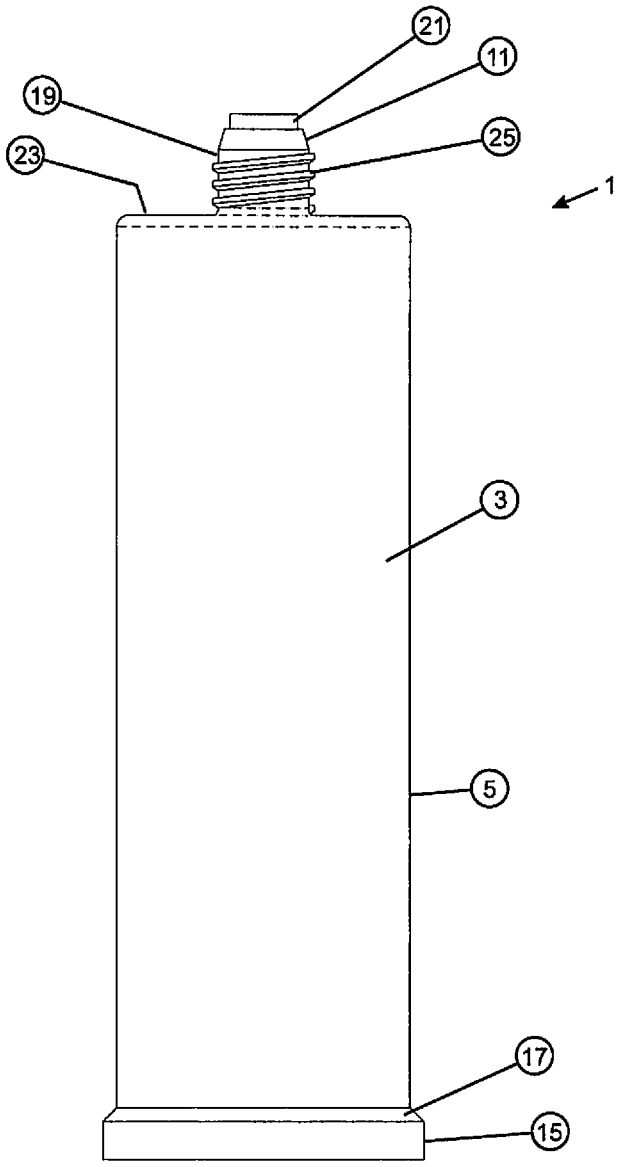
FIG. 2 is a side view of the cartridge of FIG. 1.
Figure 3:
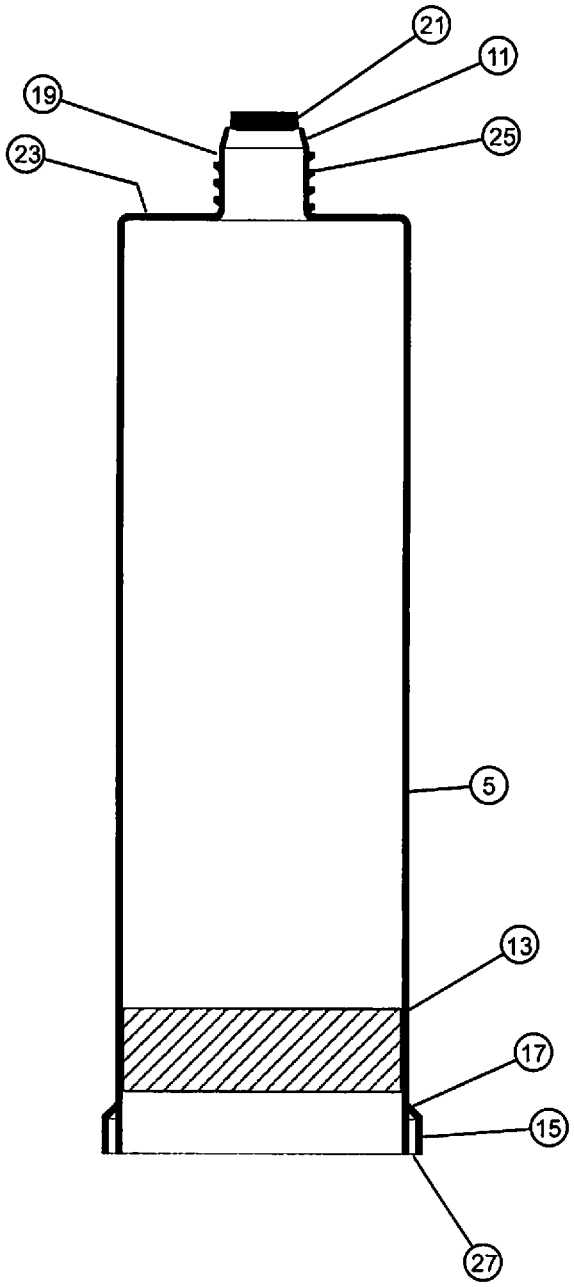
FIG. 3 is a longitudinal cross sectional view of the cartridge of FIG. 1.
Figure 4:
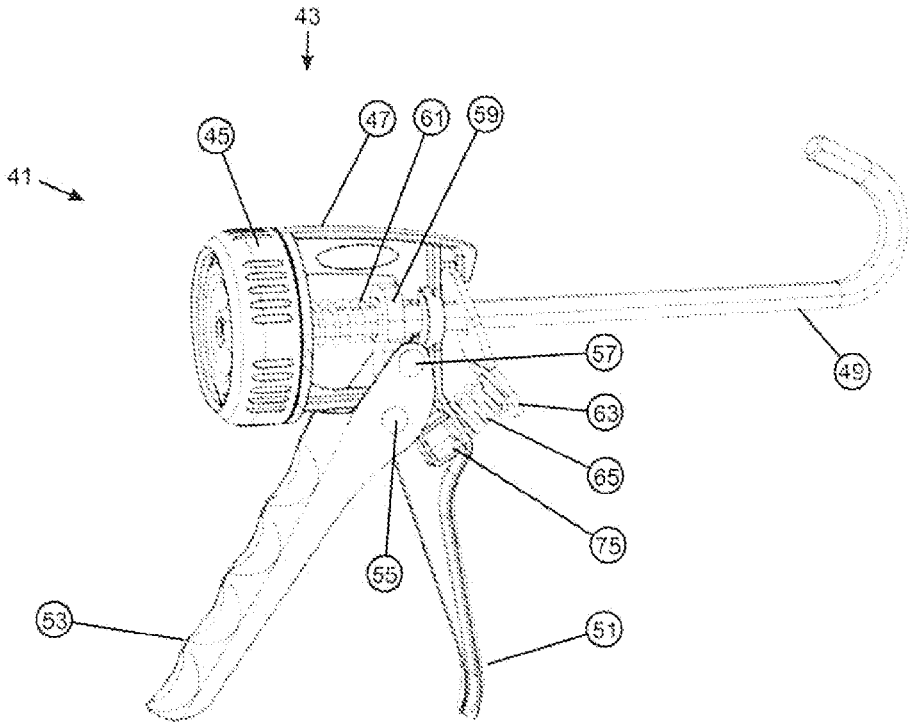
FIG. 4 is a perspective view of a compact caulking gun in accordance with a preferred embodiment of the invention.
Figure 5:
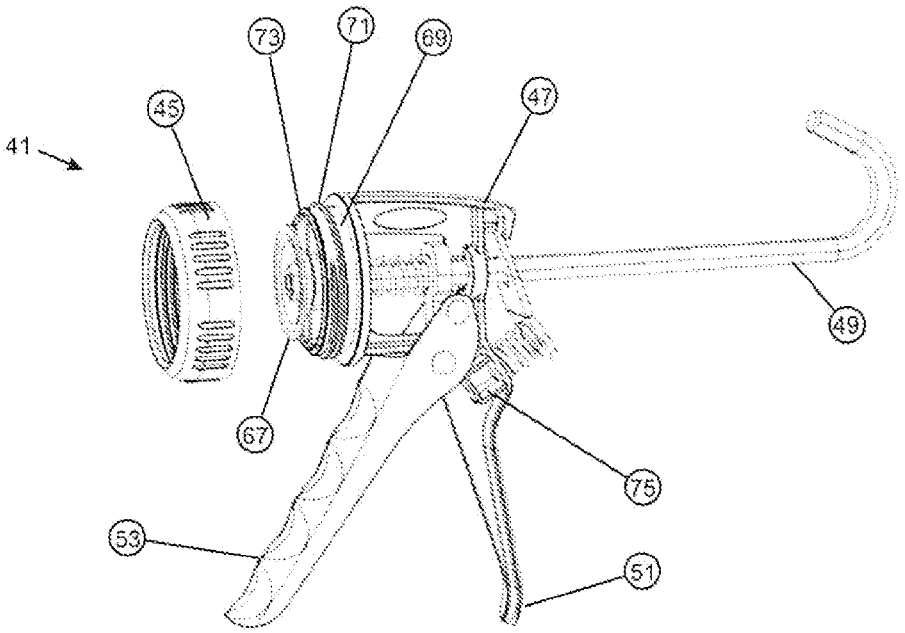
FIG. 5 is an exploded view of the compact caulking gun of FIG. 4 showing an annular fastening ring as separate from the gun body.
Figure 6:
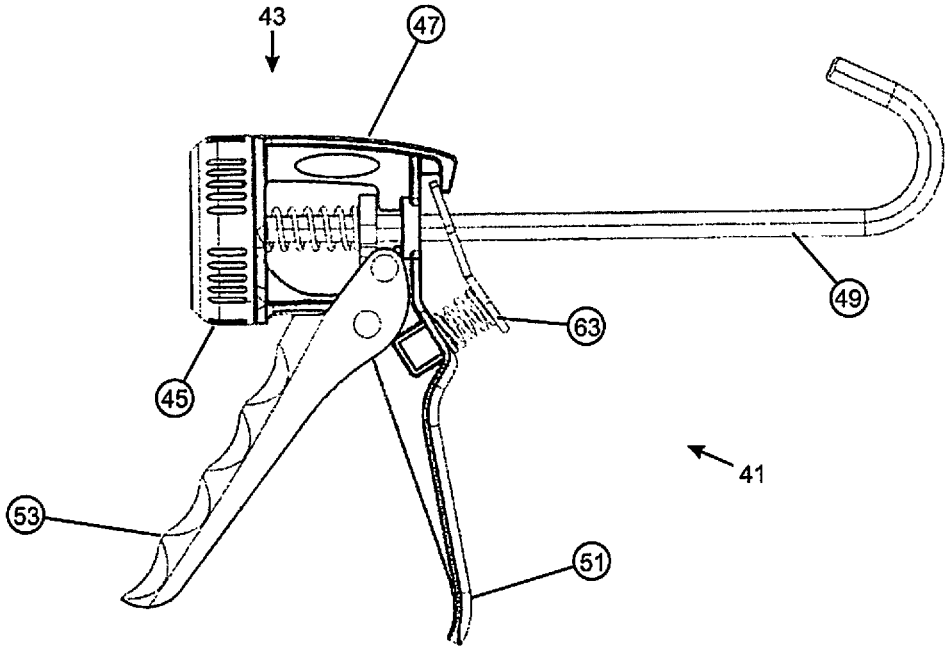
FIG. 6 is a side view of the compact caulking gun depicted in FIG. 4.
Figure 7:
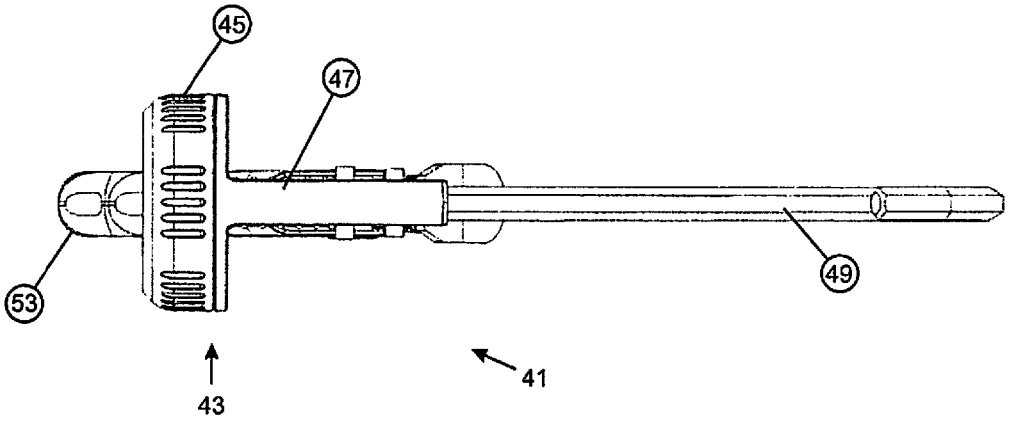
FIG. 7 is a top view of the compact caulking gun depicted in FIG. 4.

Referring initially to FIGS. 1-3 of the drawings, there is depicted a sealant cartridge 1 in accordance with a preferred embodiment of the invention. The cartridge 1 comprises an elongate hollow body 3 defined by a peripheral wall 5 extending between a top end 7 and bottom end 9 of the body 3. The top end 7 has an outlet 11 for dispensing sealant material from the cartridge 1 and the bottom end 9 is closed by a slidable piston 13 as can be seen in the cross-section view depicted in FIG. 3. The piston 13 is shaped and sized to retain the sealant material within the body 3 and is slidable along the internal surface of the peripheral wall 5 of the body 3 to thereby cause the sealant material to be discharged through the opening 11.

The cartridge 1 further includes a coupling flange 15 extending outwardly from the peripheral wall 5 of the cartridge and has an abutment surface facing upwardly at an angle towards the top end 7 of the body 3. As will be described below, the abutment surface 17 enables a downward force to be applied to the flange 15 by a corresponding downwardly facing abutment surface of a caulking gun, in accordance with a preferred embodiment of the present invention. It is the engagement of the respective abutment surfaces which connects the cartridge 1 to the caulking gun.

As can be best seen in the side view depicted in FIG. 2, or the cross-sectional view depicted in FIG. 3, the abutment surface 17 of the coupling flange 15 is disposed at an obtuse angle relative to the peripheral wall 5 of the cartridge. The angle could be anything from 90° (thereby projecting horizontally from the vertical wall 5) to almost but not quite 180°. The key point is that there must be some projection from the wall surface to enable a vertical force to be applied.

In the preferred embodiment depicted, the abutment surface 17 of the coupling flange 15 is disposed at an angle of about 135 degrees relative to the peripheral wall 5. In other words, the angle is about 45 degrees to the horizontal. The abutment surface 17 thus forms a conical shape to nest inside the annular fastening ring 45 of the caulking gun, described further below.

In alternative embodiments, not depicted, the coupling flange could be of any other form, such as a rounded bead having a uniformly curved outwardly projecting surface, or could be square or diamond shaped. The exact form of the coupling flange is not critical but the key point is that there is an abutment surface facing at least somewhat vertically upward towards the top end of the cartridge.

Further, the flange 5 depicted in FIGS. 1-3 is located adjacent the bottom end 9 of the body 3 but could instead be located further up the wall 5. Having said that, however, location of the flange at the bottom of the wall 5 allows for the most compact form of caulking gun, as will become apparent from the description of the gun further below.

As can also be seen in FIGS. 1-3, the outlet 11 includes a protrusion 19 through which the sealant material can be dispensed. The protrusion 19 is provided with a seal 21 having a square cross-section which can be grasped by a suitable tool (built into the caulking gun handle) to enable the seal 21 to be twisted and hence broken away from the protrusion 19. For this purpose, a weakened side wall of the protrusion 19 may be provided.

In the embodiment depicted, the protrusion 19 extends from a top wall 23 of the body 3 and is centered in the top wall. The protrusion 19 also includes an external thread 25 to enable a dispensing nozzle (not shown) to be secured thereto. Accordingly, the dispensing nozzle would be provided with a corresponding internal thread.

In an alternative embodiment depicted, the protrusion forming the outlet may instead include an internal thread to enable a dispensing nozzle having a corresponding external thread to be secured.

From the cross-section depicted in FIG. 3, it can be seen that the coupling flange 15 includes a downward facing channel or groove 27 which assists in aligning the cartridge 1 with a locating lip (described below) of the caulking gun.

It can also be seen that the inside wall of the cartridge 1 extends to the bottom edge of the cartridge to maximize the length of the bore. This enables improved assembly of the piston 13 into the cartridge during manufacture. It also maximizes the volume of sealant material the cartridge can hold.

Finally, although the cartridge 1 could be made of any size, the preferred form would be less than the size of conventional cartridges. In other words, the body 3 would be no longer than 215 mm and could be made within the range of 50 mm to 200 mm but more preferably within the range of 100 mm to 150 mm.

Typically, the cartridge 1 would be used to contain sealant materials (including adhesives, gels, or other viscous products) and would be prefilled with the material for convenient sale in hardware stores and the like.

Figure 10:
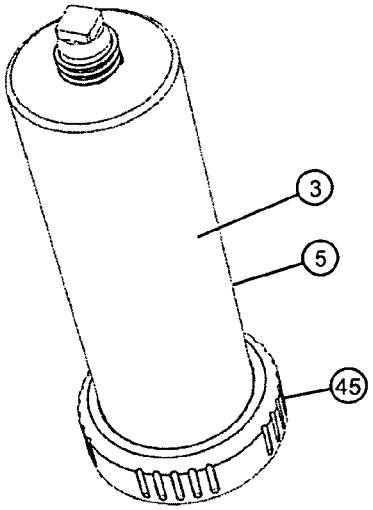
FIG. 10 is a top angled view of the cartridge depicted in FIG. 1 with the fastening ring installed.
Figure 11:
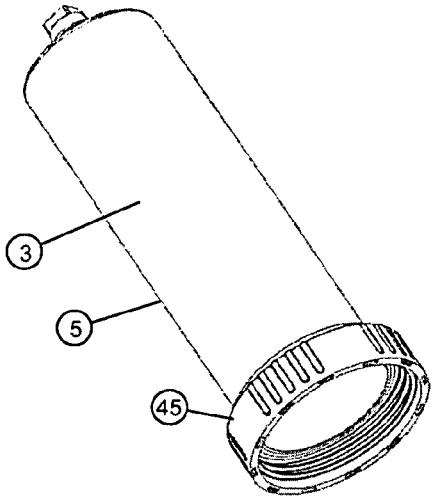
FIG. 11 is a bottom angled view of the cartridge with the fastening ring installed.

Referring now to FIGS. 4-9 of the drawings, there is depicted a caulking gun 41 in accordance with a preferred embodiment of the invention. The caulking gun 41 is designed for use with the sealant cartridge 1 depicted in FIGS. 1-3. For this purpose, the gun 41 comprises a coupling mechanism 43 in the form of an annular fastening ring 45 which, when in use with the cylindrical cartridge 1, encircles the body 3 of the cartridge 1. This arrangement can be seen in the perspective views depicted in FIGS. 10 and 11 of the drawings and the detailed cross-sectional view depicted in FIG. 17. This coupling mechanism 43 including the annular fastening ring 45 enables the cartridge 1 to be releasably connected to the caulking gun 41.

Many of the features of the caulking gun 41 are similar to conventional caulking guns and, in this regard, the caulking gun 41 includes a gun body 47, a piston rod 49, a stationary hand grip 51 and a trigger grip 53. The trigger 53 pivots about a pivot point 55 to cause forward movement of a trigger pin 57 and hence forward movement of a drive lever 59 and forward movement of the piston rod 49. A spring 61 is provided to cause the trigger 53 to return to its starting position. Similar to some conventional caulking guns, the caulking gun 41 of the preferred embodiment includes a thumb lock lever 63 which is spring loaded by means of a second spring 65. At the forward end of the piston rod 49 is a push plate 67 which acts to push against the piston 13 of the cartridge 1.

Unlike conventional caulking guns, the caulking gun 41 of the preferred embodiment of the invention includes a cylindrical opening 69 which includes an external thread 71 enabling the annular fastening ring 45 to be secured to the gun body 47. At the forward end of the opening 69 is a locating lip 73 which is shaped and positioned to engage the channel or groove 27 of the cartridge 1 (see FIG. 3).

In addition, the caulking gun 41 depicted in the drawings includes a square shaped hole 75 to provide a convenient tool so as to remove the seal 21 of the cartridge 1. The seal 21 is removed by inserting it within the hole 75 and then twisting the cartridge or the caulking gun so as to fracture the weakened portion between the seal 21 and the protrusion 19 of the cartridge outlet 11.

Figure 8:
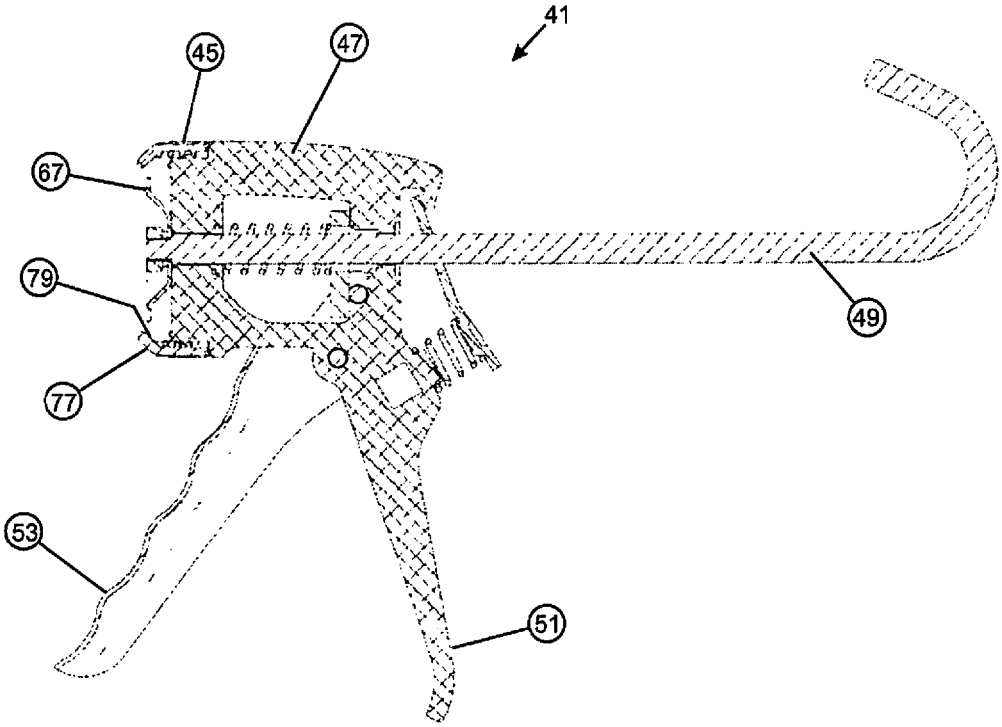
FIG. 8 is a cross sectional side view of the compact caulking gun depicted in FIG. 4.
Figure 9:
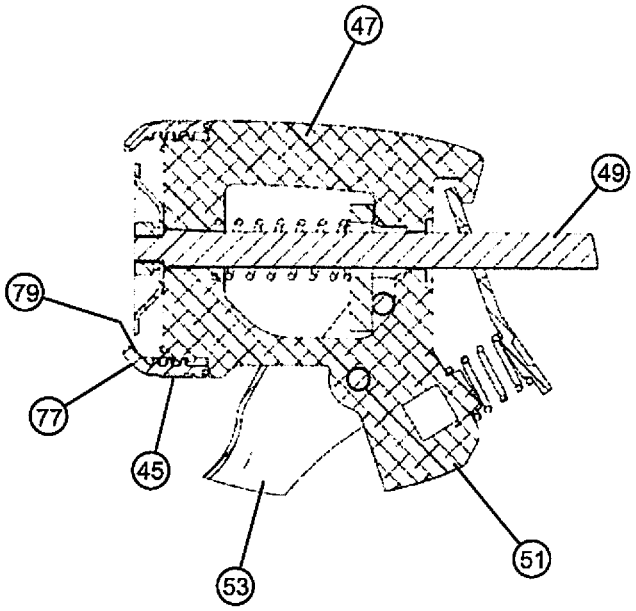
FIG. 9 is a close up partial cross sectional view along a centerline of the caulking gun depicted in FIG. 4.

Referring now to the cross-sectional view of the caulking gun 41 depicted in FIG. 8, as well as the detailed cross-section view depicted in FIG. 9, it can be seen that the annular ring 45 has an inwardly projecting lip 77. This lip 77 has an abutment surface which faces downwardly (towards the right hand side in FIGS. 8 and 9) towards the bottom end of the cartridge body 3 when the cartridge 1 is attached to the caulking gun 41. The abutment surface 79 is angled so as to correspond to the angle of the abutment surface 17 on the coupling flange 15 of the cartridge 1.

Figure 17:
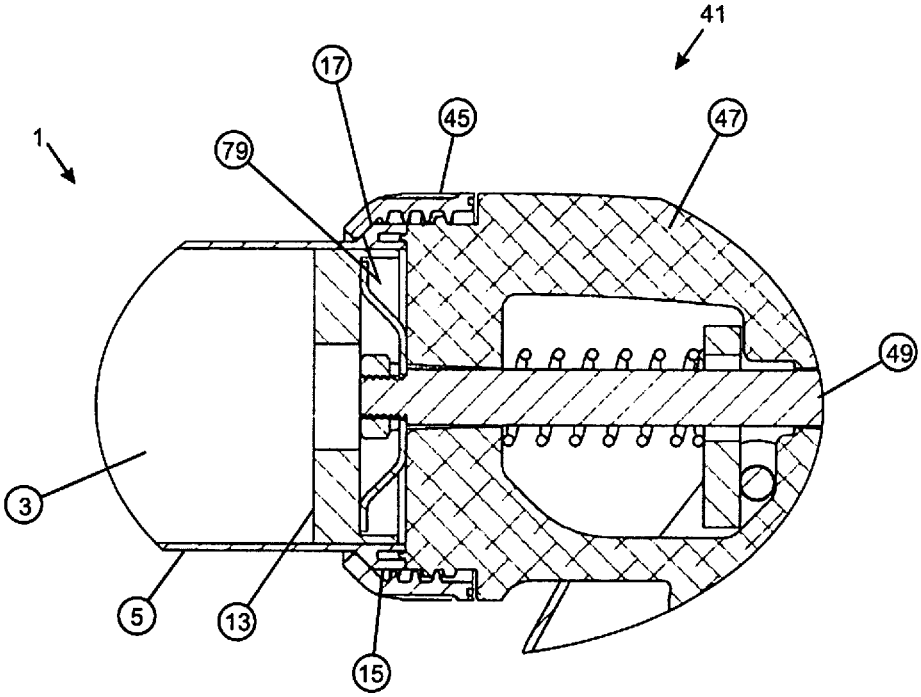
FIG. 17 is a close up partial section view, along a centerline of the cartridge and gun, depicting the interconnection between the cartridge and gun.

This relationship can best be seen in the detailed cross-sectional view of FIG. 17 wherein the cartridge 1 is depicted connected to the caulking gun 41. In this view, it can be seen that the upwardly facing (to the left in the drawing) abutment surface 17 of the cartridge flange 15 mates with the downwardly facing (to the right in the drawing) abutment surface 79 of the annular fastening ring 45 of the caulking gun 41.

Figure 12:
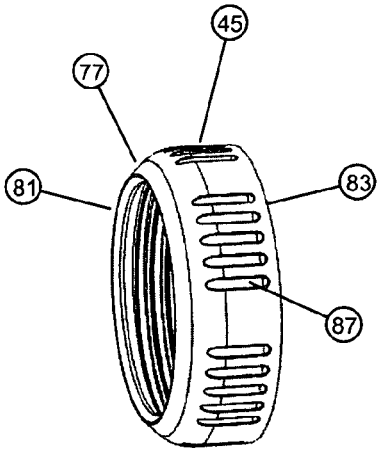
FIG. 12 is a perspective view of the fastening ring feature of the caulking gun depicted in FIG. 4 separate from the gun body.
Figure 13:
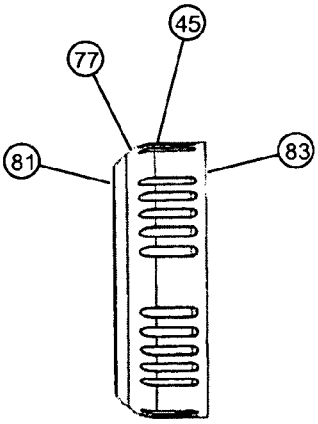
FIG. 13 is a side elevation view of the fastening ring feature of FIG. 12.
Figure 14:
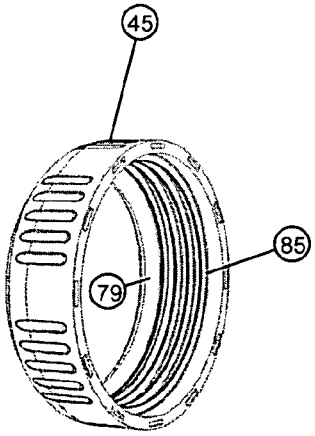
FIG. 14 is an angled internal view of the fastening ring feature of FIG. 12.

Referring now to FIGS. 12-14, there are depicted a number of views of the annular fastening ring 45. The inwardly projecting lip 77 is at the forward, or top, end 81 of the ring 45. The lip 77 thereby forms a hole of a reduced diameter relative to the ring 45 for holding the cartridge 1 by its flange 15 and preventing it from penetrating all the way through the forward end 81 of the ring 45. The rearward, or bottom, end 83 of the ring 45 is hollow with an inner cavity extending to the forward end 81 of the ring 45. As can be seen, the internal wall of the ring 45 includes an internal thread 85 extending from the rearward end 83 towards the forward end 81, suitable for mating with the external thread 71 of the opening 69 of the gun body 47 when the ring 45 is positioned over the opening and is fastened or unfastened to the gun body 47.

In the embodiment depicted, the ring 45 includes segmented grooves 87 on its outside surface to provide easy grip when fastening and unfastening the ring 45 from the opening 69 of the gun body 47. In this embodiment, the segmented grooves 87 are parallel to each other and parallel to a central axis of the ring 45. Alternative formations could however be included to facilitate grip as would be understood by a person skilled in the art.

As stated above, the ring 45 is hollow to enable the ready insertion of the sealing cartridge 1. Upon insertion, the sealant cartridge extends through the ring until the conically shaped abutment surface 17 of the flange 15 meets, and nests within, the corresponding shaped abutment surface 79 of the ring 45. This prevents the cartridge from passing all the way through the ring 45. Once the cartridge is inserted through the ring 45, it can be screwed onto the opening 69 of the gun body 47. Since the fastening ring 45 is the primary holding device for the cartridge 1, the angled surfaces help spread the load over a wider area as the flange 15 of the cartridge 1 seats into the retaining ring 45. This is an improvement over a 90 degree flange where the corner becomes a stress concentrator and an area for potential failure. Also, since the cartridge 1 may be filled with various types of materials having different viscosities, the angled flange helps to support the pressure applied to it from across this broad range of materials.

Figure 15:
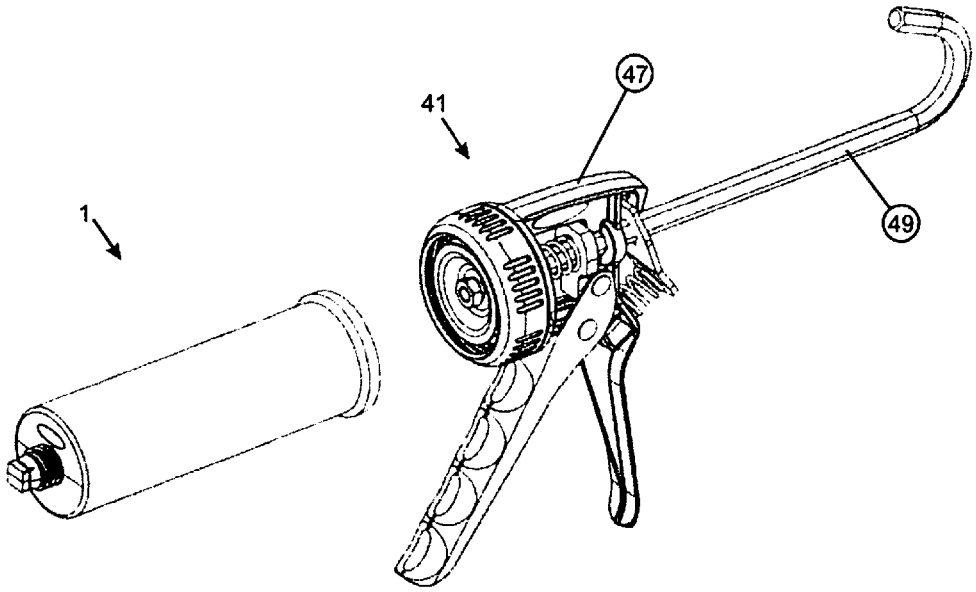
FIG. 15 is a perspective view of the caulking gun of FIG. 4 separate from the sealant cartridge of FIG. 1 before insertion.
Figure 16:
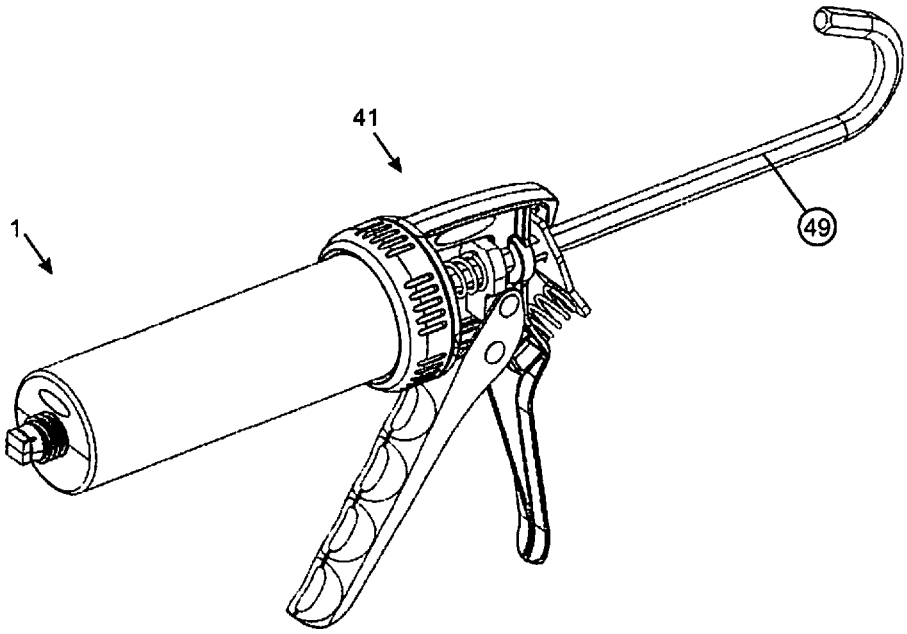
FIG. 16 is a perspective view of the caulking gun of FIG. 4 and the sealant cartridge of FIG. 1 assembled.
Figure 18:
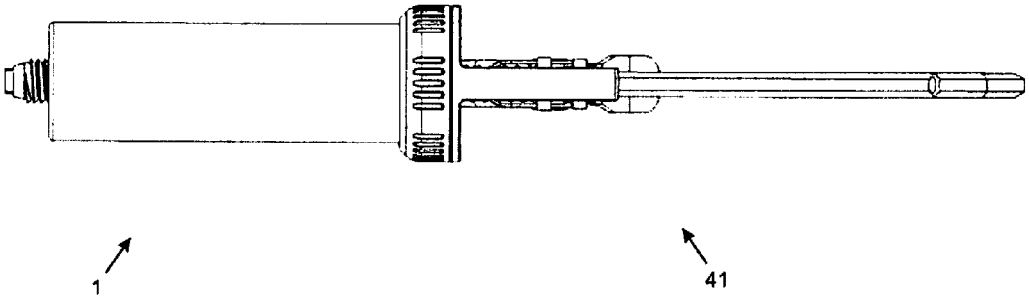
FIG. 18 is a top view of the caulking gun of FIG. 4 and the cartridge of FIG. 1 assembled.

Referring now to FIGS. 15, 16 and 18, FIG. 15 depicts the cartridge 1 separate from the caulking gun 41 before it is connected. FIG. 16, on the other hand, depicts the cartridge 1 connected to the caulking gun 41 by means of the annular fastening ring 45. FIG. 18 depicts a top view of the connected cartridge 1 and caulking gun 41.

Figure 19:
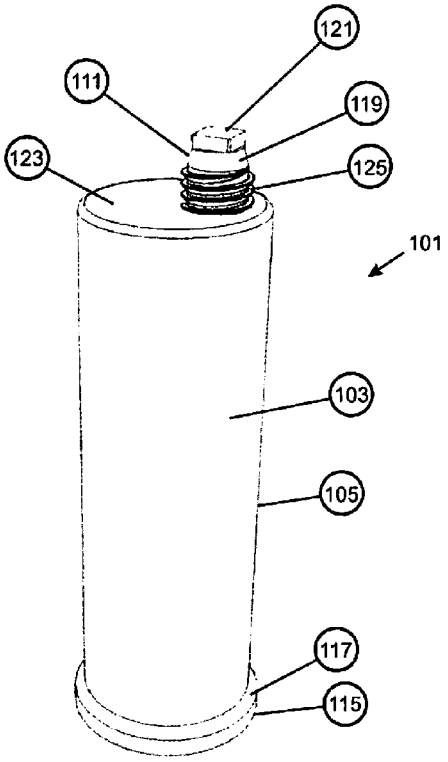
FIG. 19 is perspective view of another particular embodiment of the compact sealant cartridge with the cartridge outlet positioned off-center.
Figure 20:
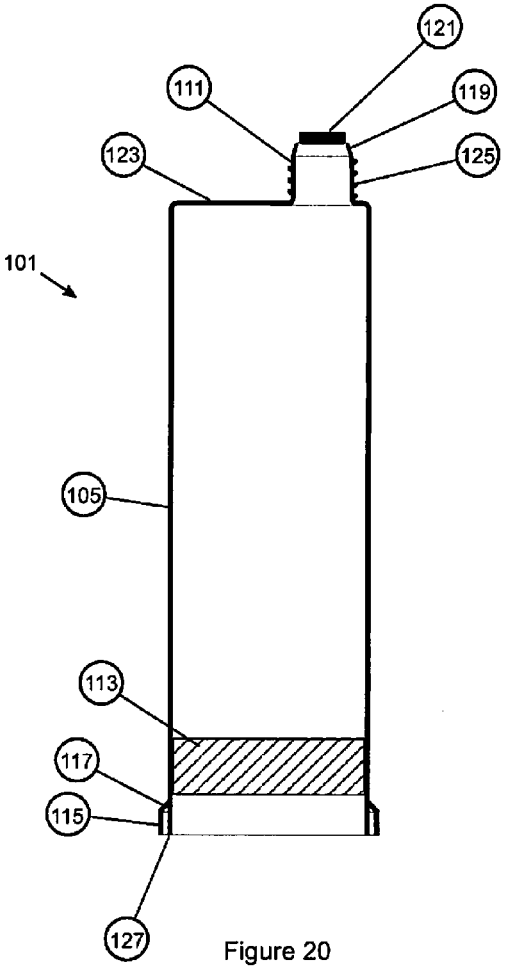
FIG. 20 is a longitudinal cross section of the cartridge of FIG. 19.
Figure 21:
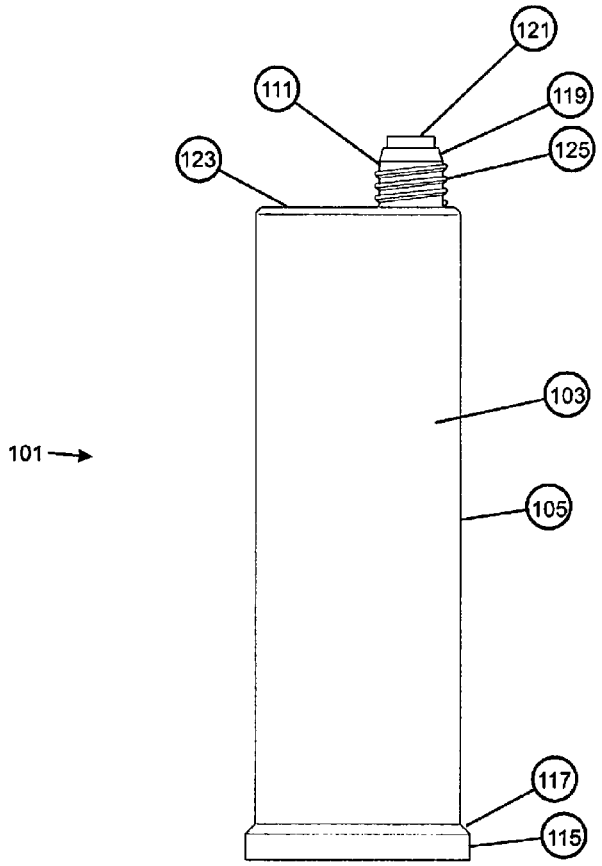
FIG. 21 is a side view of the cartridge of FIG. 19.

Referring now to FIGS. 19-22, there is depicted a sealant cartridge 101 in accordance with an alternative embodiment of the invention. Similar reference numerals are used in these figures as have been used in the preceding figures to identify equivalent features in this embodiment. Thus, the cartridge body 103 in FIG. 19 is equivalent to cartridge body 3 in FIG. 1. All remaining reference numerals follow a similar pattern.

Figure 22:
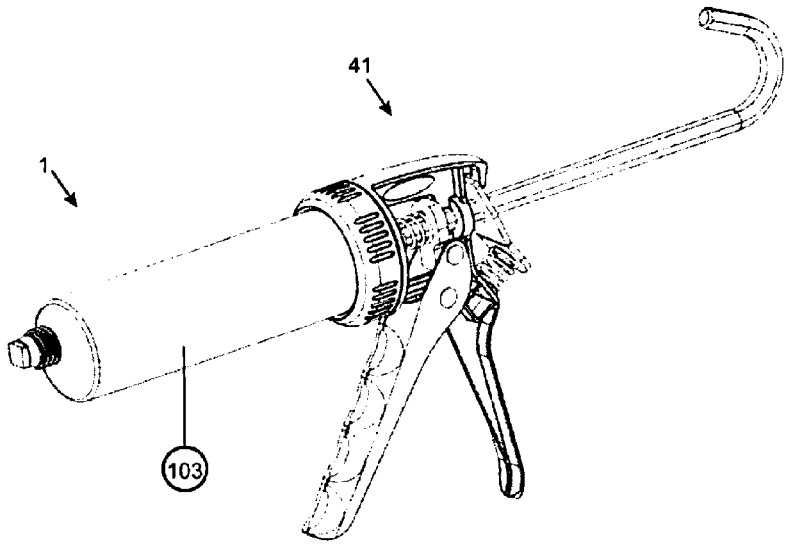
FIG. 22 is a perspective view of the caulking gun of FIG. 4 and the cartridge of FIG. 19 assembled.

As can be seen, the primary difference between the embodiment depicted in FIGS. 19-22 and that depicted in the earlier figures is that the outlet 111 of the cartridge 101 is off-centered in the top wall 123 so as to be closer to the peripheral wall 115. This arrangement allows for improved accessibility and maneuverability in restricted spaces. Despite the difference in the cartridge 101, it can be used with an identical caulking gun 41, as depicted in FIG. 22.

Figure 23:
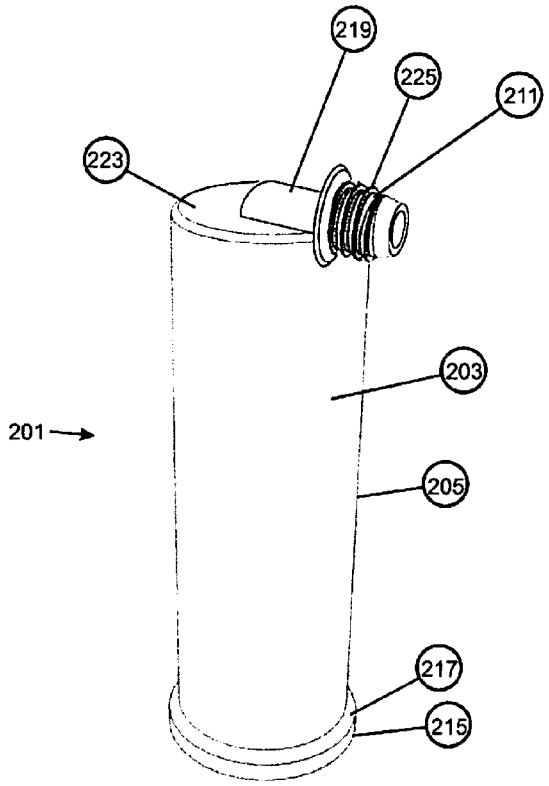
FIG. 23 is a perspective view of another particular embodiment of the compact sealant cartridge with the cartridge outlet positioned on a top shoulder edge between the top wall and side wall of the cartridge.
Figure 24:
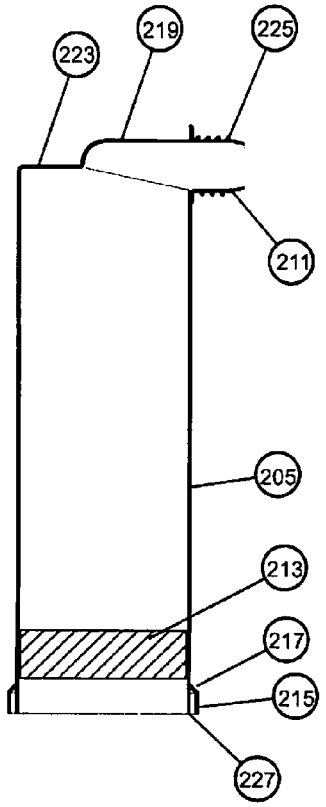
FIG. 24 is a longitudinal cross section of the cartridge of FIG. 23.
Figure 25:
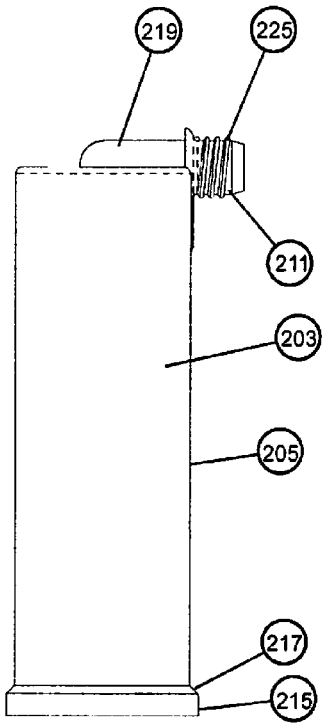
FIG. 25 is a side view of the cartridge of FIG. 23.

Along similar lines, a further alternative cartridge 201 in accordance with a further embodiment of the invention is depicted in FIGS. 23-25. Similar reference numerals have again been used to identify features corresponding to the features of the earlier embodiments. In this embodiment, the outlet 211 projects laterally from a location adjacent the intersection between the peripheral wall 205 and the top wall 223. In all other respects, the embodiment depicted in FIGS. 23-25 is the same as the embodiment depicted in FIGS. 1-3 and 19-21.

Those skilled in the art will appreciate that the invention described herein is susceptible to variations and modifications other than those specifically described herein for the purposes of illustration. Such variations and modifications are to be considered within the scope of the invention, the nature of which is to be determined from the foregoing description and/or the following claims.

The invention claimed is:

1. A cartridge suitable for containing a sealant material and configured to be coupled to a caulking gun having a caulking gun body and an annular fastening ring, the cartridge comprising:

an elongate hollow body defined by a peripheral wall extending between a top end and a bottom end of the body, the top end having an outlet for dispensing sealant material from the cartridge and the bottom end being closed by a slidable piston, wherein the piston is adapted to retain the sealant material within the body and is slidable within the body to thereby cause the sealant material to be discharged through the outlet, the cartridge further comprising a coupling flange extending outwardly from at least a portion of the peripheral wall and having an abutment surface configured to enable engagement with a corresponding abutment surface of a caulking gun to thereby couple the cartridge to the caulking gun, wherein the abutment surface of the coupling flange faces upwardly towards the top end of the body and is disposed at an obtuse angle with respect to the peripheral wall, to thereby enable a downward force to be applied to the flange by a corresponding downwardly facing abutment surface of the annular fastening ring of the caulking gun, such that when the annular fastening ring is fully threadably coupled to the caulking gun body, a rearward end of the annular fastening ring makes abutting contact with a portion of the caulking gun body, and wherein the coupling flange includes a downward facing channel or groove to assist alignment of the cartridge with a corresponding locating lip of a caulking gun.

2. A cartridge as defined in claim 1 wherein the obtuse angle is about 135 degrees.

3. A cartridge as defined in claim 1 wherein the flange is located adjacent the bottom end of the peripheral wall.

4. A caulking gun for dispensing sealant material from a cartridge, the cartridge being a cartridge as defined in claim 1, and the caulking gun comprising a coupling mechanism to enable the cartridge to be releasably connected to the caulking gun, wherein the coupling mechanism surrounds at least a portion of the cartridge body and includes an abutment surface which is configured to engage the abutment surface of the cartridge.

5. A cartridge as defined in claim 1 wherein the flange is continuous about the peripheral wall such that the flange surrounds the body.

6. A cartridge as defined in claim 5 wherein the body of the cartridge is cylindrical and the flange is of uniform cross section, such that the flange has an outer diameter greater than an outer diameter of the body and has a height which is uniform about the body.

7. A cartridge as defined in claim 1 wherein the length of the cartridge body is no longer than 215 millimeters.

8. A cartridge as defined in claim 7 wherein the length of the cartridge body is about 150 millimeters.

9. A cartridge as defined in claim 1 wherein the outlet includes a hollow protrusion through which the sealant material can be dispensed.

10. A cartridge as defined in claim 9 wherein the protrusion extends from a top wall of the body and is centered in the top wall.

11. A cartridge as defined in claim 9 wherein the protrusion extends from a top wall of the body and is off-centered in the top wall.

12. A cartridge as defined in claim 9 wherein the protrusion extends from an external surface of the peripheral wall.

13. A cartridge as defined in claim 9 wherein the protrusion extends from the body at a location adjacent an intersection between the peripheral wall and a top wall of the body.

14. A cartridge as defined in claim 9 wherein the protrusion includes an external thread to enable a dispensing nozzle having a corresponding internal thread to be secured thereto.

15. A caulking gun for dispensing sealant material from a cartridge, the cartridge comprising an elongate hollow body defined by a peripheral wall extending between a top end and a bottom end of the body, the top end having an outlet for dispensing sealant material from the cartridge and the bottom end being closed by a slidable piston, wherein the piston is adapted to retain the sealant material within the body and is slidable within the body to thereby cause the sealant material to be discharged through the outlet, the cartridge further comprising a coupling flange extending outwardly from at least a portion of the peripheral wall and having an upwardly facing abutment surface disposed at an obtuse angle with respect to the peripheral wall and a downwardly facing channel or groove, and the caulking gun comprising a coupling mechanism to enable the cartridge to be releasably coupled to the caulking gun, wherein the coupling mechanism includes an annular fastening ring configured to surround at least a portion of the cartridge body and threadably couple to the caulking gun body to thereby couple the caulking gun to the cartridge, such that when the annular fastening ring is fully threadably coupled to the caulking gun body, a rearward end of the annular fastening ring makes abutting contact with a portion of the caulking gun body, wherein the annular fastening ring includes a downwardly facing abutment surface, disposed at an obtuse angle to correspond with the upwardly facing abutment surface of the coupling flange, and wherein the caulking gun body includes an upwardly projecting locating lip which is shaped and positioned to assist alignment of the caulking gun with the corresponding downwardly facing channel or groove of the cartridge.

16. A caulking gun as defined in claim 15 wherein the coupling mechanism fully surrounds the cartridge body to enable engagement with a continuous flange surrounding the cartridge body.

17. A caulking gun as defined in claim 15 wherein the coupling mechanism includes a clamping arrangement to pull the respective abutment surfaces together and thereby rigidly couple the cartridge to the caulking gun.

18. A caulking gun as defined in claim 15 wherein the coupling mechanism includes a fastening band which is shaped to surround the flange and body of the cartridge, the band having an inwardly projecting lip which is configured to extend over the flange towards the peripheral wall of the body, and the abutment surface of the coupling mechanism is disposed beneath the lip.

19. A caulking gun as defined in claim 18 wherein the fastening band is circular in cross section so as to form an annular ring which, when in use with a cartridge having a cylindrical body, encircles the body of the cartridge, the inwardly projecting lip thereby forming an aperture having a diameter which is smaller than an internal diameter of the remainder of the annular ring.

20. A caulking gun as defined in claim 19 wherein the annular ring includes an internal thread which is configured to engage with an external thread associated with a body portion of the caulking gun such that rotation of the annual ring causes the respective abutment surfaces to be drawn together.

21. A caulking gun as defined in claim 19 wherein the abutment surface of the annular ring is disposed at said obtuse angle with respect to an internal wall of the annular ring.

22. A caulking gun as defined in claim 21 wherein the angle is about 135 degrees.

* * * * *